US010767364B2

(12) United States Patent
Rodriguez

(10) Patent No.: US 10,767,364 B2
(45) Date of Patent: Sep. 8, 2020

(54) REFRACTORY ENCLOSURES FOR HIGH DENSITY ENERGY STORAGE SYSTEMS

(71) Applicant: Alonso P. Rodriguez, Pasadena, CA (US)

(72) Inventor: Alonso P. Rodriguez, Pasadena, CA (US)

( * ) Notice: Subject to any disclaimer, the term of this patent is extended or adjusted under 35 U.S.C. 154(b) by 0 days.

(21) Appl. No.: 16/013,129

(22) Filed: Jun. 20, 2018

(65) Prior Publication Data

US 2019/0017262 A1 Jan. 17, 2019

Related U.S. Application Data

(60) Provisional application No. 62/523,255, filed on Jun. 22, 2017.

(51) Int. Cl.

| | |
|---|---|
| ***E04B 1/94*** | (2006.01) |
| ***E04B 2/74*** | (2006.01) |
| *E06B 5/16* | (2006.01) |
| *A62C 3/06* | (2006.01) |
| *A62C 3/16* | (2006.01) |
| *E04H 9/10* | (2006.01) |
| *A62C 2/06* | (2006.01) |
| *E04H 1/12* | (2006.01) |

(52) U.S. Cl.

CPC ..... *E04B 1/941* (2013.01); *E04B 1/948* (2013.01); *A62C 2/06* (2013.01); *A62C 3/06* (2013.01); *A62C 3/16* (2013.01); *E04B 1/945* (2013.01); *E04B 1/946* (2013.01); *E04B 1/947* (2013.01); *E04B 2/7411* (2013.01); *E04H 9/10* (2013.01); *E04H 2001/1283* (2013.01); *E06B 5/162* (2013.01)

(58) Field of Classification Search

CPC ..... E04B 1/941; E04B 1/948; E04B 2/7411; E04B 1/946; E04B 1/947; E04B 1/945; E06B 5/162; A62C 3/06; A62C 3/16; A62C 2/06; E04H 9/10; E04H 2001/1283

USPC ..... 52/396.01, 656.3, 741.3, 784.11, 787.11, 52/794.1, 834

See application file for complete search history.

(56) References Cited

U.S. PATENT DOCUMENTS

| | | | | |
|---|---|---|---|---|
| 2,144,598 A | | 1/1939 | Brinckerhoff et al. | |
| 2,785,099 A | | 3/1957 | Holtsford | |
| 4,011,697 A | * | 3/1977 | Fedolfi | E04B 1/24 52/92.3 |

(Continued)

FOREIGN PATENT DOCUMENTS

| | | |
|---|---|---|
| FR | 2860981 A1 | 4/2005 |
| KR | 20080059710 A | 7/2008 |

OTHER PUBLICATIONS

Rich Walker, Testing of Fire Resistance and Smoke Resistant Assemblies, UL Codes and Advisory Services, p. 9 (Year: 2015).*

(Continued)

*Primary Examiner* — Brent W Herring

(74) *Attorney, Agent, or Firm* — Laura M. King; Matrix Law Group, LLP

(57) ABSTRACT

The present is a containment enclosure made from refractory material. The enclosure contains a plurality of panels and a plurality of columns made from refractory material. The enclosure has an interior portion and an exterior portion, and wherein the enclosure contains the effects of extreme fire as well as contains the effects of explosions.

20 Claims, 5 Drawing Sheets

(56) References Cited

U.S. PATENT DOCUMENTS 4,683,019 A * 7/1987 Motoki ..... E04B 1/944 106/601
4,858,398 A * 8/1989 Ricchini ..... E04B 1/14 52/91.3
5,052,569 A * 10/1991 Cooper ..... B65D 90/023 220/1.5
5,167,098 A 12/1992 Blackwelder
5,203,707 A * 4/1993 Musto ..... A62C 99/0081 434/226
5,391,019 A * 2/1995 Morgan ..... B28B 1/52 264/256
5,483,548 A 1/1996 Coble
5,511,908 A * 4/1996 Van Valkenburgh ..... B65F 1/1426 206/386
5,573,348 A * 11/1996 Morgan ..... B28B 1/52 264/256
5,678,369 A * 10/1997 Ishikawa ..... E04B 1/942 52/309.9
5,706,614 A * 1/1998 Wiley, Jr. ..... E04B 1/3483 52/537
5,735,639 A * 4/1998 Payne ..... B65D 88/121 206/386
5,785,591 A * 7/1998 Payne ..... B65D 88/121 220/1.5
6,393,775 B1 * 5/2002 Staschik ..... C02F 9/00 210/170.08
6,688,048 B2 * 2/2004 Staschik ..... C02F 9/00 52/220.1
7,823,357 B2 * 11/2010 Westra ..... E04B 1/94 52/1
8,118,925 B2 2/2012 Rodriguez
8,221,540 B2 7/2012 Rodriguez
9,338,907 B2 * 5/2016 Bell ..... H05K 7/20918
2002/0189173 A1 * 12/2002 Staschik ..... C02F 9/00 52/79.1
2007/0044391 A1 * 3/2007 Richardson ..... E04B 1/34321 52/79.1
2007/0113487 A1 * 5/2007 Warminsky ..... E04H 9/10 52/79.1
2007/0175108 A1 * 8/2007 Stein ..... E04B 1/34321 52/79.5
2008/0134589 A1 * 6/2008 Abrams ..... E04B 1/003 52/79.1
2008/0134628 A1 6/2008 Hiel
2010/0162929 A1 * 7/2010 Smit ..... E04B 1/3483 109/79
2012/0247037 A1 10/2012 Rodriguez
2013/0284223 A1 10/2013 Watters
2014/0116870 A1 * 5/2014 Kamen ..... E04H 1/1205 202/83
2014/0283464 A1 * 9/2014 Vogler ..... E04B 1/34321 52/79.5
2015/0064514 A1 * 3/2015 Wu ..... H01M 10/658 429/56
2016/0088753 A1 * 3/2016 Bell ..... H05K 7/20918 361/696
2017/0080264 A1 3/2017 Rodriguez
2017/0159317 A1 6/2017 Johansen

OTHER PUBLICATIONS

Britannica Online Encyclopedia, Refractory, Encyclopedia Britannica, Inc., <https://www.britannica.com/technology/refractory> (Year: 2016).*
"Distributed Energy Products," https://www.tesla.com/utilities, Jun. 18, 2018, (pp. 1/5-5/5).
"Fired Refractory Shapes and Crucibles," Morgan Advanced Materials, http://www.morganthermalceramics.com/en-gb/products/fired-refractory-shapes-and-crucibles, 2016, (5 pages).
"Fireproof Enclosure Installation, Operation, and Maintenance Instructions," Thermal Design, Inc., Oct. 2003, http://www.tdiuk.com/images/stories/documents/Thermal_Designs_Inc_-_Fireproof_Enclosures_installation.html, (5 pages).
"Grid Scale Energy Storage Technologies Market," London, CISION PRNewswire, May 8, 2017, -2030, https://www.prnewswire.com/news-releases/grid-scale-energy-storage-technologies-market-2017-2030-300453751.html,(pp. 1-9).
"Oldcastle Precast Trufire Walls are the Critical Line of Defense," Old Castle Precast Energy Flyer Nov. 28, 2018 vol. 1, 2016, OldCastle Precast,Inc., https://oldcastleprecast.com/trufire-walls, (2 pages).
D'Aprile, Paolo et al., "The new economics of energy storage," MicKinsey&Comany, Aug. 28, 2018, https://www.mckinsey.com/sustainability-and-resource-productivity/our-insinghts/the-new-ecnomics-of-energy-storage, (pp. 1/9-9/9).
Link, P. F., "Incinerator Refractory Enclosures," National Incinator Conference, M. H. Detrick Company, New York, New York, 1964, pp. 58-60 (3 pages).
USPTO, International Search Report (ISR) and Written Opinion issued by the International Searching Authority/US in related International Patent Application No. PCT/US2018/038321 dated Sep. 7, 2018.
USPTO, International Preliminary Report on Patentability (IPRP) issued by the International Searching Authority/US in related International Patent Application No. PCT/US2018/038321. 7 Pages.

* cited by examiner

REFRACTORY ENCLOSURES FOR HIGH DENSITY ENERGY STORAGE SYSTEMS

CROSS-REFERENCE TO RELATED APPLICATIONS

This application claims the benefit of U.S. Provisional Patent Application No. 62/523,255, filed on Jun. 22, 2017, entitled "Refractory Enclosures for High Density Energy Storage Systems," the contents of which are incorporated herein by reference in its entirety.

BACKGROUND

Electrically powered devices and equipment require that electricity flow the instant the equipment's switch is turned on. Electrical consumers assume that the power system has the generating capacity, or sources, in sufficient amount to provide all electrical loads with the power needed to turn on and keep those loads operating as long as needed. However, as electrical energy demand continues to dramatically increasing worldwide, as new types of electrical loads are continuously being connected, and as traditional fossil fuels are being replaced by renewable sources, a clear and urgent need for massive energy storage has become vital. Without bulk energy storage, the probability that electrical equipment might not turn on when the switch is turned on and then stays on is increasing exponentially as time passes.

In order to provide consumers with electricity when it is needed, high density energy storage systems that are connected to the power system at all times are used. The principle is to store excess energy produced from renewable sources during periods of low demand in order to supplement the erratic, non-dispatchable, and more costly renewable sources during the hours of high demand.

Due to space, economic, and mobility constraints, the energy density in these storage systems must be maximized. The most prevalent High Density Energy Storage Systems (HDESS) today consist of interconnected lithium ion cells. The number of cells can vary from one cell as used in small instruments, to a few cells as in smartphones, to hundreds of thousands of cells as used in battery banks in electrical utility substations.

Compaction of battery banks has been the predominant design option in order to increase energy density. Reduced battery pack sizes have been achieved by reducing the spacing between the cell electrodes and reducing the thickness of electrical and thermal insulation. However, by reducing cell and battery pack dimensions, there is an increased propensity for lithium ion powered devices and battery banks to ignite and/or explode violently. The close proximity of heat generating components with reduced heat dissipation can create thermal runaway effects, which have been documented in the technical literature and the media to lead to serious fires and explosions. This type of runaway phenomenon also applies to other battery types and other high energy density technologies.

Also contributing to the severity of lithium ion battery fire is the extremely high rate of energy release once the cells have been compromised. For comparison, the energy release rates of lithium ion cells is higher than that of liquid fuels such as gasoline and mineral oil. The heat flux driven by the elevated energy release rates is what can ignite neighboring equipment and cause collateral damage as these fires spread at very high speeds away from their source of origin.

Compounding the problem are two clear trends: 1) A further increase in energy densities by improving cell chemistry and by more miniaturization of the storage banks; and 2) A continued increase in the ratings of the battery banks. For utility power system applications the required battery banks will range from a few megawatts to several gigawatts in power ratings, and corresponding increased energy ratings depending on the applications. For example, at the power distribution level, batteries rated 10 MW at 40 MWh have already been installed. For transmission applications typical ratings could be about 1.6 GW at 35 GWh.

Such enormous amounts of energy concentrated in relatively compact installations must be confined in the event the energy is suddenly released due to a malfunction, accident, or thermal or electrical insulation breakdown. Currently, utility and industrial-size battery banks are packaged in metal enclosures, which resemble modified shipping containers. However, under the intense and long duration fire of a HDESS, such as lithium ion battery banks, these enclosures could explode or rupture and the fire could extend to other parts of the facility, putting equipment, personnel and the public at risk.

The present invention relates to enclosures made out of refractory material to effectively contain the extreme thermal hazards of fires and explosions caused by refineries, large energy-storage battery banks, electrical transformers, and oil-filled transformers in power substations, as well as extreme fires and explosions created by HDESS such as: utility scale lithium ion battery banks; zinc, lead and other metal battery banks; hydrogen fueled arrays; supercapacitor sets; charging stations; and liquefied natural gas tanks.

SUMMARY

The present invention is directed, in part, to enclosures that satisfy the need of containing extreme fires and explosions. One containment enclosure of the present invention has a plurality of panels made from refractory material, and a plurality of columns made from refractory material. The enclosure has an interior portion and an exterior portion and contains the effects of extreme fires and/or explosions within the enclosure. The enclosure can be made up of 6 or more panels, and 4 or more columns.

The enclosure can contain any material or equipment, such as a high density energy storage system source. It is contemplated that the high density energy storage system source can be one or more battery banks, hydrogen fueled arrays, supercapacitor set, charging stations, and liquefied natural gas tanks. In one aspect, the battery bank can be a metal battery bank such as zinc, lead, and lithium.

The containment enclosure can be rectangular. In one aspect, the exterior portion of the enclosure is completely closed to the environment, or partially open to the environment. It is contemplated that the interior of the enclosure further can contain one or more panels made from refractory material.

It is also contemplated that the exterior of the enclosure has a mechanical structural reinforcement. The mechanical structural reinforcement can be a non-refractory mechanical structural reinforcement. The non-refractory mechanical structural reinforcement can provide aesthetic features to the enclosure. The non-refractory mechanical structural reinforcement can be completely closed to the environment. In one aspect, the non-refractory mechanical structural reinforcement can be connected to the refractory material by one or more connectors. The non-refractory mechanical structural reinforcement can be steel.

In one aspect, the refractory materials can contain reinforcement materials. The reinforcement materials can be resistant to penetration from ballistics, and/or can mitigate sound.

DRAWINGS

These and other features, aspects, and advantages of the present invention will become better understood with regard to the following description, appended claims, and accompanying drawings.

DETAILED DESCRIPTION

Figure 1:
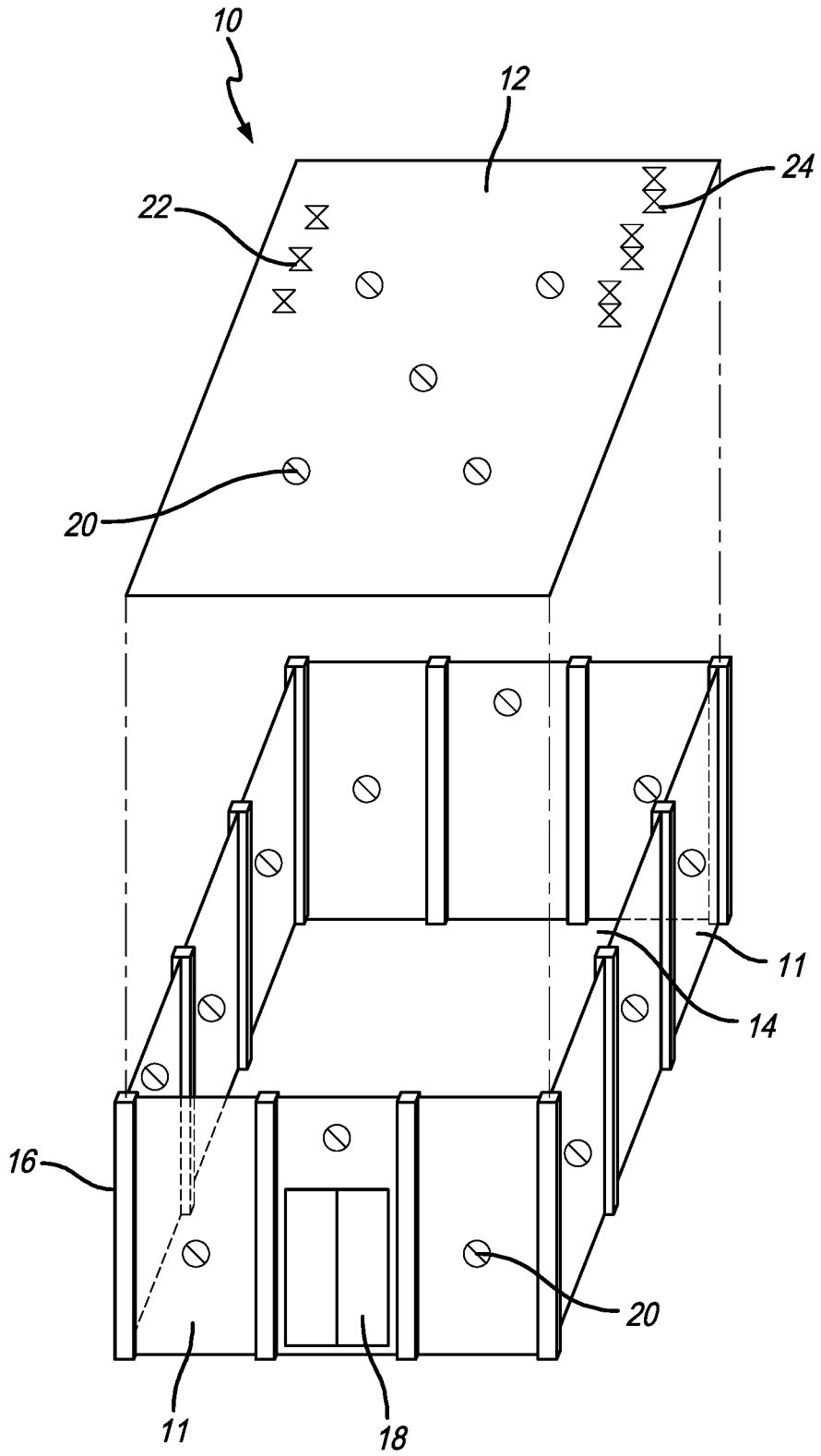
FIG. 1 is a perspective view of a refractory enclosure according to the present invention.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used herein, the term "comprise" and variations of the term, such as "comprising" and "comprises," are not intended to exclude other additives, components, integers or steps.

As used herein, the term "extreme fire" refers to a high heat flux fire with temperatures exceeding 900 degrees Celsius, such as, for example, an oil fire or a lithium ion battery bank fire.

The term "combustion" refers to rapid chemical reactions releasing heat and light energy.

The term "refractory material" as used herein refers to material containing a refractory composition. Refractory compositions are known, such as in U.S. Pat. No. 8,118,925, which describes a concrete refractory material comprising cement, a binder such as calcium silicate, calcium aluminate, or aluminum silicate, water, and a matrix material. The matrix material comprises both stainless steel fibers and organic fibers. The refractory composition can also contain a reinforcing material.

As used herein, "standard concrete" refers to material containing common aggregates, a Portland cement binder, and water.

Energy storage systems must have a high energy density to be economically and technically feasible. Bulk energy storage currently has an energy density that tends to approach that of liquid fuels. The trend is toward even higher densities and larger magnitude storage capacities. The inherently hazardous characteristics of large energy storage facilities, together with the extremely high energy release rates during a failure makes safety a top concern. Effective protection against extreme fire and accompanying explosions is essential in the safe use of high density energy storage.

These extreme fires frequently can burn for many hours and generate intensive heat flux, and cannot be extinguished, and hence require special fire containment methods. For example, a utility scale lithium ion battery bank can release as much energy as a gasoline tank of about the same weight.

To be able to confine extreme fires and explosions to their origin requires materials that are resistant to high heat fluxes and high temperatures and can withstand long fire durations. While the most common industrial construction materials, such as concrete and steel, are nonflammable or noncombustible, these materials are not resistant to the typical fire conditions present in an extreme fire within an HDESS facility. In fact, steel and standard concrete lose about 50% of their room temperature strength at about half the working temperature of an extreme fire typical of an oil fire or a lithium ion battery bank fire.

Steel usually regains most of its strength once it cools back to room temperature, but steel structural components, such as I-beams, will deform significantly in an extreme fire. They will not regain their original shapes and will separate from the concrete matrix, thus collapsing the structure. Furthermore, standard concrete cannot be used in an extreme fire because standard concrete suffers an irreversible chemical change at relatively low fire temperatures and reverts back to its basic ingredients: sand and limestone.

However, refractory concrete can withstand extreme fires. Refractory concrete temporarily loses only about 10% of its room temperature strength at the maximum fire temperatures ranging from about 900 to 1,200 degrees Celsius. In fact, the thermal properties of refractories can be enhanced by firing the materials at high temperatures. Refractory concrete is a superior material that can meet the thermal and structural requirements for enclosures designed to contain the extreme fires associated with HDESS facilities.

Despite its excellent thermal and structural properties, it was only until the last decade that refractory concrete material has been used in structural applications. The first commercial use of refractory concrete material was in the form of large monolithic components to construct fire walls for the purpose of containing oil fires in power substations (U.S. Pat. Nos. 8,118,925, and 8,221,540).

As described above, the refractory material used in the present invention is made up of a composition comprising cement, a binder, water, and a matrix material which has both stainless steel fibers and organic fibers. The cement used can be any suitable cement, such as Portland cement. The binder can be any suitable binder, such as calcium silicate, calcium aluminate, or aluminum silicate. The refractory composition can also contain a reinforcing material to increase point of impact strength, ballistic resistance, as well as mitigate sound. The reinforcing material can be, for example, an organic material such as, aromatic polyamide (sold by DuPont under the trademark Kevlar®), carbon, composites, or an inorganic material such as, for example, stainless steel, graphene, or special high temperature glass.

The refractory materials can be cast into large panels suitable for use in constructing the particular enclosure to specified measurements. For example, refractory panels used in the present invention are typically between about 5 feet and about 10 feet in length, between about 2 feet and about 5 feet in width and between about 1 inch and about 3 inches in thickness. Such refractory fire containment panels typically weigh between about 400 pounds and about 800 pounds.

The cost of the materials used in refractory concrete make enclosures made from refractory materials more expensive than traditional construction materials on a per pound basis. However, refractory concrete might be the only technical solution in certain uses, as is the case for HDESS facilities. In such applications, practical and economic designs can be achieved by judiciously combining refractory concrete with conventional materials.

Previously, refractory materials have been used to protect items such as equipment from high temperatures from external sources. However, refractory materials have not been previously used to enclose or contain high temperature fires or explosions, as in the present invention.

FIGS. 1-5 illustrates the present invention, namely a modular refractory enclosure 10 made of panels and columns made out of refractory material and used to house a structure such as, for example, an HDESS installation. While a rectangular prism configuration is shown in the figures, it is contemplated that any other shape can be used, such as, for example, domes, hemispheres, pyramids, multi-story, or layered combinations can be made as required by the application. Monolithic prefabricated refractory components cast in a concrete plant can be used to assemble the enclosures 10 on-site, such as at the HDESS site. The walls 11, roof 12, and floor 14 of the refractory enclosure 10 are comprised of a plurality of refractory panels assembled together by, for example, by tongue-and-groove joints. The number of refractory panels used in the enclosure 10 is variable depending on the shape of the structure and the size of the walls 11 used in the enclosure 10. The foundation or floor 14 can be made from refractory material, and can be cast-in-place or assembled at the site of the enclosure 10 using one or more refractory panels.

Other materials such as coatings and reinforcements can be applied to the refractory panels to increase their blast strength, sound absorption, and ballistic resistance as needed. The enclosures 10 can be closed completely or partially open.

A plurality of columns 16 support the vertical refractory panel walls 11, which slide into the column grooves in the case of a tongue and groove assembly. The number of columns 16 is variable depending on the shape of the enclosure 10 and the size of the walls 11 used. The walls 11 are attached to the columns 16. The attachments can be, for example, specially designed hardware embedded into the columns and covered with a coating of refractory mortar such that the hardware is shielded against high temperatures. The coating of refractory mortar should be a minimum of three inches thick. It is contemplated that additional intermediate columns 16 might be needed for larger enclosures 10.

Blast and fire-resistant doors 18 are shown in FIGS. 1-3 and 5. Means to release pressure in the enclosure 10 such as by, for example, one or more pressure relief valves 20 in the walls 11 and roof 12 is necessary to mitigate the pressure waves generated during an explosion. Also shown in FIGS. 1-3 and 5 is one or more optional low voltage electrical bushing insulators 22 and high voltage electrical bushing insulators 24 used to transport power in or out of the enclosure 10.

The auxiliary buildings for control, HVAC, telecommunications, personnel, etc. would be located outside the enclosure 10. The enclosure 10 keeps these buildings isolated and safe from extreme fire or explosion caused by the contents inside the enclosure 10.

Figure 2:
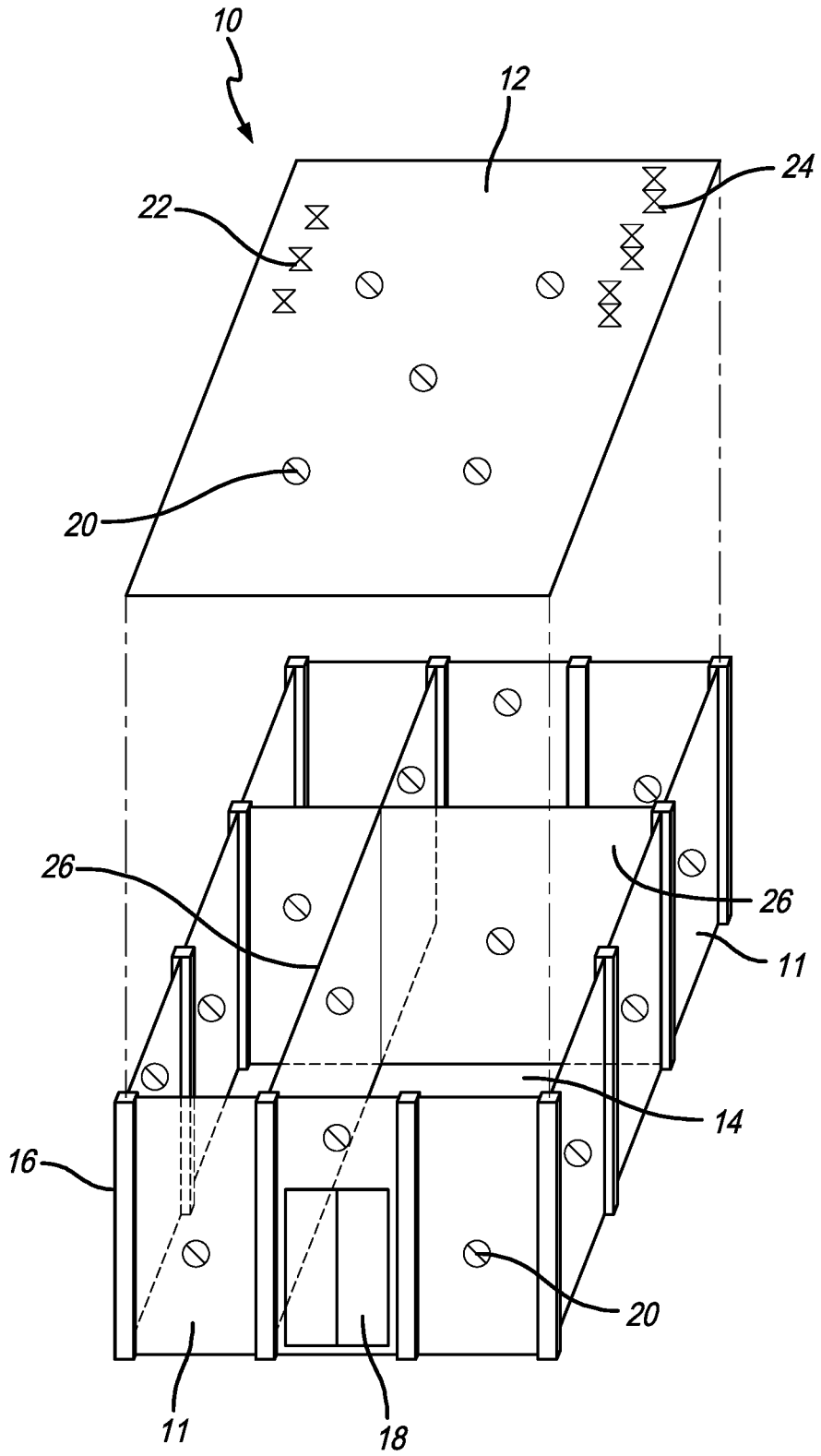
FIG. 2 is a perspective view of a refractory enclosure according to one aspect of the present invention.

FIG. 2 shows one aspect of the invention with a compartmentalized configuration containing refractory partitions 26, which are strategically sized and placed to confine extreme fire and explosion damage to smaller areas within the enclosure 10 and/or protect critical assets within the enclosure 10. These partitions 26 are also assembled from refractory panel walls 11 and columns 16. The partitions 26 can vary in size and number as needed by the application.

It is also contemplated that the refractory material used in the enclosure 10 could be engineered to direct blast stresses to the nearest relief points, such as the pressure relief valves 20 or mechanical joints as well as to absorb energy in the refractory material's matrix. This could be done using embedded oriented fibers, a sacrificial porous coating (as done for acoustic energy absorption), and/or flexible ingredients in the mix.

Figure 3:
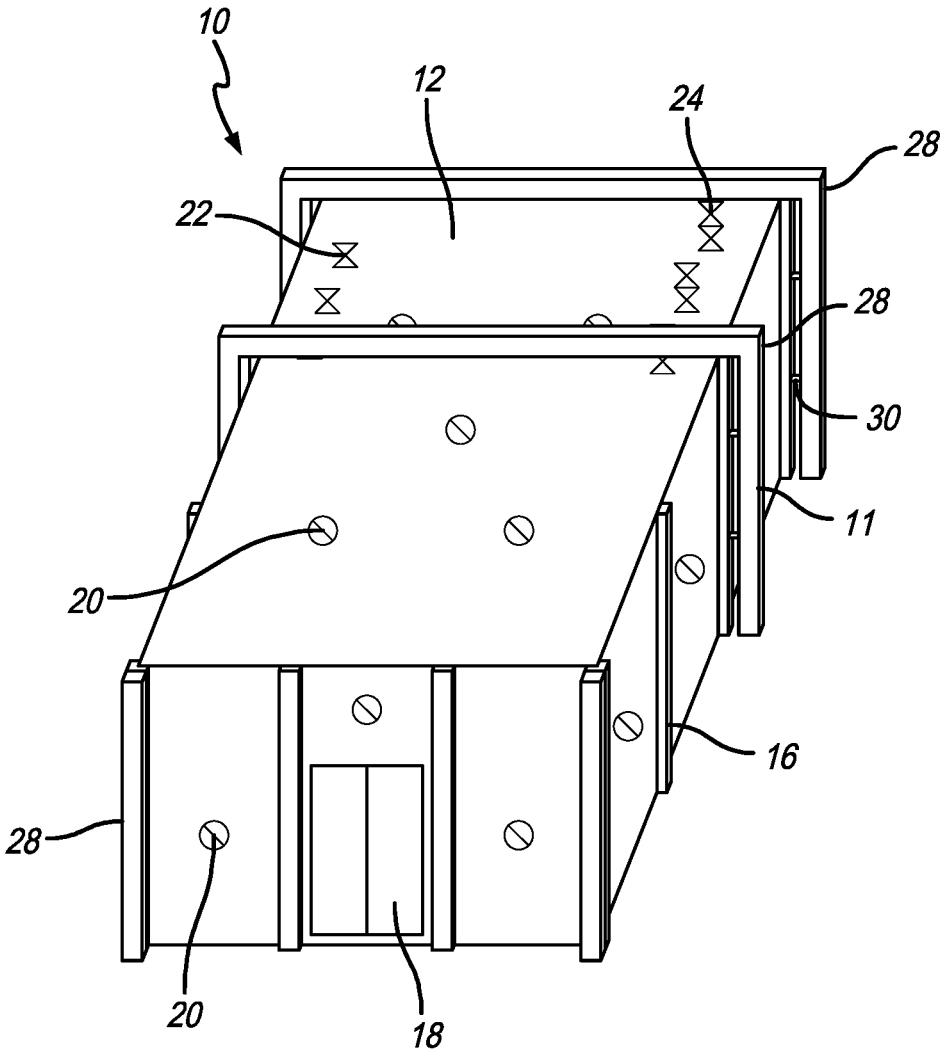
FIG. 3 is a perspective view of a refractory enclosure according to another aspect of the present invention.
Figure 4:
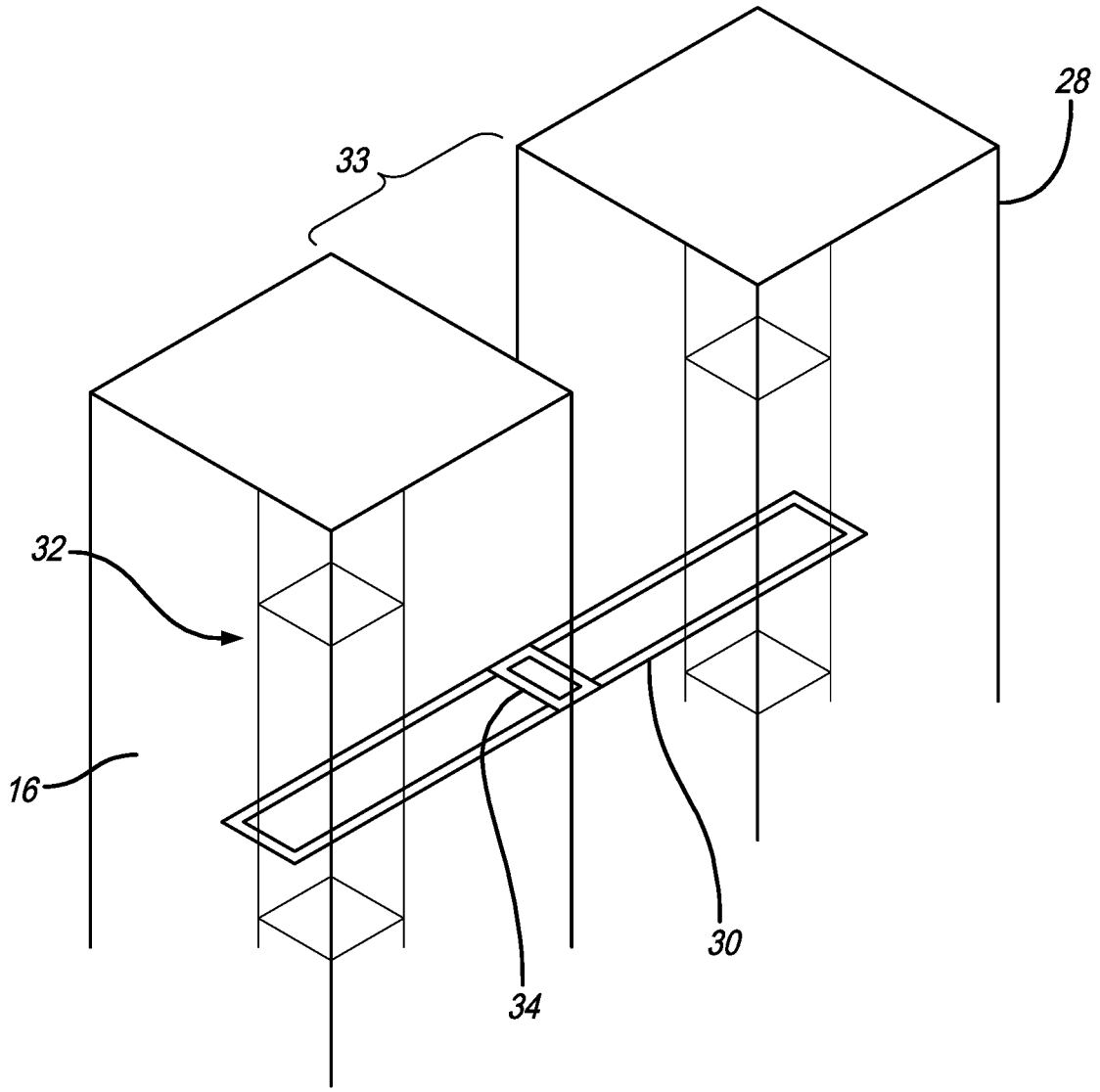
FIG. 4 is a perspective view showing the relationship between the refractory columns and concrete columns of the refractory enclosure according the invention shown in FIG. 3.

The cost of an enclosure 10 made from refractory material can be substantially reduced by supplementing the load bearing columns 16 containing refractory material with one or more lower cost standard concrete columns 28 and beams 29 that share the mechanical load of the enclosure 10, as shown in FIGS. 3 and 4. In turn, the refractory enclosure 10 protects the standard concrete columns 28. This is simply done by locating the standard concrete columns 28 outside the enclosure 10, and mechanically coupling the refractory columns 16 with the standard concrete columns 28 with a connector 30 such as, for example, a stainless steel connector 30. The connector 30 has two halves and a third plate to join the two halves. During casting of the refractory, one of the halves is connected (welded or bolted) to an internal reinforcement 32 such as a rebar cage within the standard concrete column 28. The other half is connected in the same manner to the refractory column's 16 internal reinforcement 32. The two columns 16, 28 are separated by an air gap 33 of about one to two feet. In this air gap 33, the two free ends of the connector 30 halves are spliced together by welding or bolting. The number, size, grade, and location of the connecters 30 are determined by structural requirements of the enclosure 10.

Only standard concrete columns 28 and beams 29 are shown in FIG. 3 for simplicity in illustrating the concept of the invention. However, these columns 28 and beams 29 could be used as a framework to attach a second layer of walls 11 and/or a roof 12, forming a shell-like structure, which would enclose the refractory enclosure 10 with an additional layer of refractory material for increased protection. Additionally, the columns 28 and beams 29 could be made from a material such as, for example, steel.

Figure 5:
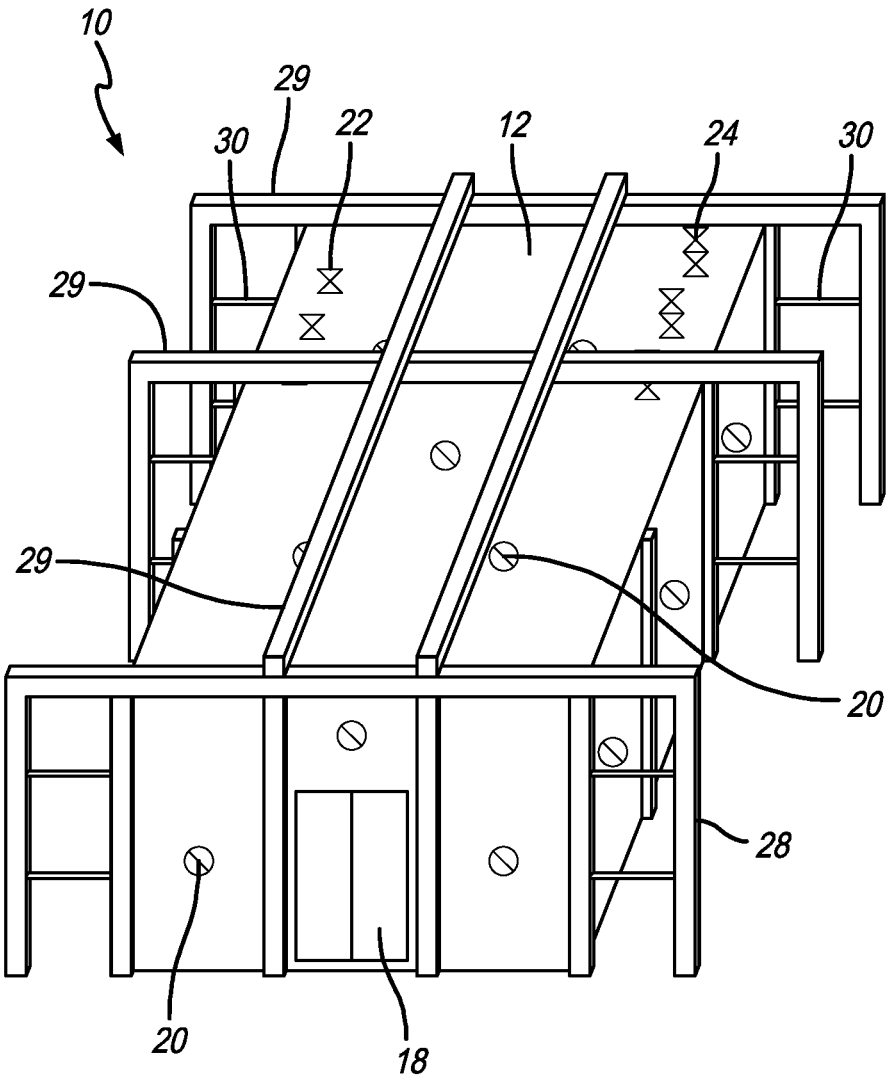
FIG. 5 is a perspective view of a refractory enclosure according to one aspect of the present invention.

A preferred embodiment of the present invention is shown in FIG. 5. In this embodiment, steel beams 29 are used to form a supplemental exoskeleton outside the refractory enclosure 10. As described above, the columns 28 and the refractory columns 16 are coupled with a connector 30, which is connected to the refractory column's 16 internal reinforcement 32 at one end, and to the column 28 at the other end. Columns 16 are connected to beams 29 using a connector 30 as described above.

Additional variations could be introduced by the use of other structurally acceptable materials, as the refractory enclosure provides the primary thermal and blast protection. For example, ornamental concrete or wood could be used to present an aesthetically pleasing façade. It is also contemplated that the enclosures of the invention can be quickly installed or disassembled and transported for reuse at other sites. Furthermore, the enclosures of the invention can be scaled up or down as energy storage needs increase or decrease.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

The invention claimed is:

1. A utility-sized containment enclosure for containing the effects of extreme fires and explosions produced by a high density energy storage system (HDESS) connected to an electric utility, the enclosure comprising:

a. a plurality of panels made from refractory material, wherein the refractory material comprises a binder and a refractory matrix material, and b. a plurality of columns made from refractory material, wherein the refractory material comprises a binder and a refractory matrix material;

wherein the utility-sized enclosure comprises an interior portion and an exterior portion, wherein the utility-sized containment enclosure comprises one or more means to release internal pressure from within the utility-sized containment enclosure, wherein the means to release internal pressure is selected from the group comprising pressure relief valves, refractory materials, and mechanical joints, and wherein the utility-sized containment enclosure contains the effects of extreme fires and explosions within the utility-sized containment enclosure for a duration of at least four hours.

2. The utility-sized containment enclosure of claim 1, wherein the plurality of panels comprises 6 or more panels.

3. The utility-sized containment enclosure of claim 1, wherein the plurality of refractory columns comprises 4 or more columns.

4. The utility-sized containment enclosure of claim 1, wherein the bulk energy rating of the HDESS is between 40 megawatt-hours to 35 gigawatt-hours.

5. The utility-sized containment enclosure of claim 4, wherein the HDESS source is selected from the group comprising one or more battery banks, hydrogen fueled arrays, supercapacitor set, charging stations, and liquefied natural gas tanks.

6. The utility-sized containment enclosure of claim 5, wherein the battery bank is a metal battery bank.

7. The utility-sized containment enclosure of claim 6, wherein the metal is selected from the group comprising zinc, lead, and lithium.

8. The utility-sized containment enclosure of claim 1, wherein the exterior portion of the utility-sized containment enclosure is rectangular.

9. The utility-sized containment enclosure of claim 1, wherein the exterior portion of the utility-sized containment enclosure is completely closed to the environment.

10. The utility-sized containment enclosure of claim 1, wherein the exterior portion of the utility-sized containment enclosure is partially open to the environment.

11. The utility-sized containment enclosure of claim 1, wherein the interior of the utility-sized containment enclosure further comprises one or more panels made from refractory material.

12. The utility-sized containment enclosure of claim 1, wherein the exterior of the utility-sized containment enclosure further comprises a mechanical structural reinforcement.

13. The utility-sized containment enclosure of claim 12, wherein the mechanical reinforcement comprises a non-refractory mechanical structural reinforcement.

14. The utility-sized containment enclosure of claim 13, wherein the non-refractory mechanical structural reinforcement provides aesthetic features to the enclosure.

15. The utility-sized containment enclosure of claim 13, wherein the non-refractory mechanical structural reinforcement is completely closed to the environment.

16. The utility-sized containment enclosure of claim 13, wherein the non-refractory mechanical structural reinforcement is connected to the refractory material by one or more thermally isolating mechanical connectors.

17. The utility-sized containment enclosure of claim 13, wherein the non-refractory mechanical structural reinforcement is steel.

18. The utility-sized containment enclosure of claim 1, wherein the refractory materials further comprise reinforcement materials.

19. The utility-sized containment enclosure of claim 18, wherein the reinforcement materials are resistant to penetration from ballistics.

20. The utility-sized containment enclosure of claim 18, wherein the reinforcement materials mitigate sound.

* * * * *